United States Patent [19]

DeRoseau

[11] Patent Number: 5,042,712

[45] Date of Patent: Aug. 27, 1991

[54] COMBINATION FOOD CONTAINER AND EATING UTENSIL

[76] Inventor: Robert F. DeRoseau, 4322 Clearview Dr., Clarkston, Mich. 48348

[21] Appl. No.: 493,940

[22] Filed: Mar. 15, 1990

Related U.S. Application Data

[62] Division of Ser. No. 232,802, Aug. 16, 1988, Pat. No. 4,930,637.

[51] Int. Cl.[5] ..... B65D 3/00

[52] U.S. Cl. ..... 229/1.5C; 220/90.2; 220/85 H; 215/DIG. 5

[58] Field of Search ..... 206/234, 541; 229/1.5 C, 103.1; 220/90.2, 85 D; 215/DIG. 5

[56] References Cited

U.S. PATENT DOCUMENTS

| | | | |
|---|---|---|---|
| 1,514,379 | 11/1924 | Fleischer . | |
| 1,625,335 | 4/1927 | Schneider . | |
| 1,768,771 | 7/1930 | Tourrette | 229/1.5 C |
| 2,353,582 | 7/1944 | Pearson . | |
| 2,509,616 | 5/1950 | Rafoth et al. | 229/1.5 C |
| 2,584,379 | 2/1952 | Chmielewski | 229/1.5 C |
| 3,679,093 | 7/1972 | Chang . | |
| 3,921,889 | 11/1975 | Gibbons | 229/103.1 |
| 4,078,692 | 3/1978 | Stein | 220/90.2 |
| 4,573,631 | 3/1986 | Reeves | 220/90.2 |

*Primary Examiner*—David T. Fidei
*Attorney, Agent, or Firm*—Alex Rhodes

[57] ABSTRACT

A combination food container and utensil for prepared food, by way of example, frozen dinners and restaurant carryouts. The food container has a partitioned body which is adapted for storing food and utensils, a cover attached to the upper portion of the body and at least one utensil, such as, a knife, fork or spoon inside of the body. The body has a bottom wall, a side wall extending upwardly from the outer edge of the bottom wall and a flange extending outwardly from the upper edge of the side wall. A vertical pocket is formed by the cover and an inner wall which extends upwardly from the bottom wall and joins the side walls of the body. The utensil inside of the pocket is accessible when the cover is detached from the body.

4 Claims, 1 Drawing Sheet

COMBINATION FOOD CONTAINER AND EATING UTENSIL

This is a divisional of copending application Ser. No. 07/232,802, filed on Aug. 16, 1988, now U.S. Pat. No. 4,930,637.

BACKGROUND OF THE INVENTION

This invention relates to food containers and more particularly to disposable food containers for preserving food, by way of example, frozen dinners and restaurant carryouts, which include eating utensils. One aspect of the current practice is that containers for prepared foods do not include knives, spoons or forks for partaking of the foods. The objection to this practice is that the utensils are often inadvertently omitted or not available at the sources of the foods.

Another aspect of the current practice is that the food utensils which are supplied with prepared foods are generally supplied without outer wrappings. The objection to this practice is that unwrapped utensils pose a health risk.

Despite the benefits of providing eating utensils in food containers, none of the combination food container and utensil concepts of the prior art have achieved commercial success. It is believed that the reasons they have not achieved success is the added cost and/or functional deficiencies.

Fleischer U.S. Pat. No. 1,514,379, Schneider U.S. Pat. No. 1,625,335 Pearson U.S. Pat. No. 2,353,582 and Chang U.S. Pat. No. 3,679,093 are exemplary of food containers having utensils in the prior art.

Fleischer U.S. Pat. No. 1,514,379, more than sixty years ago, patented a construction for an ice cream cup with a cover containing a spoon. The cover was comprised of a bottom member and a top sheet of waterproof paper bonded to an outwardly-extending flange portion of the bottom member.

Shortly after Fleischer patented his ice cream cup, Schneider U.S. Pat. No. 1,625,335 patented an ice cream cup having a paper cover with an exposed utensil portion which was separable from the cover along a tear line.

Pearson U.S. Pat. No. 2,353,582 patented an ice cream cup having a cover formed of a plurality of layers and a partially exposed spoon stored between the layers of the cover.

Chang U.S. Pat. No. 3,679,093 patented a food container having a utensil enclosed in a compartmented cover which was accessible by severing a portion of the outer covering along a perforated line.

In view of the objections to the current practice and the variety of concepts for a combination food and utensil container which have long been available in the prior art, it will be appreciated that a long felt need exists which, as yet, remains unsatisfied.

SUMMARY OF THE INVENTION

The present invention is a disposable combination food container and eating utensil. It is contemplated that the invention will be used by the general public for purposes such as, picnics and student and worker box lunches as well as for commercially prepared foods, such as, frozen foods and restaurant carryouts.

The invention comprises a body which is adapted for preserving food, at least one utensil stored in a pocket of the container for partaking of the food inside of the container, and a novel means for positioning the utensil in the pocket of the container. A significant benefit of the invention is that utensils are provided inside of a container at a lower cost than heretofore possible.

The utensil is stored in a sealed pocket which is integral with the body of the container.

The foregoing objects, features, and benefits along with other objects, features and benefits as well as the manner of practicing the invention in accordance with the best mode contemplated will be understood from the ensuing description and accompanying drawings which described the invention in detail.

DETAILED DESCRIPTION OF THE PREFERRED EMBODIMENT

Figure 1:
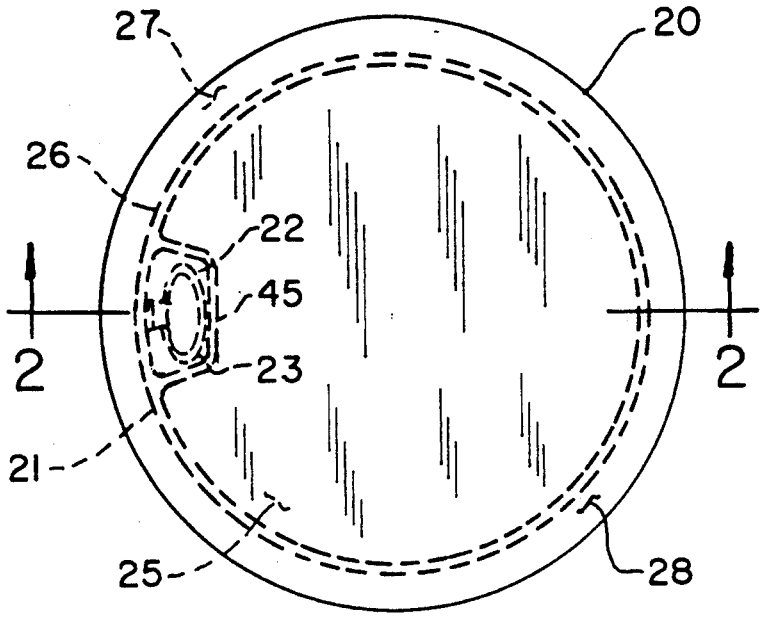
FIG. 1 is a plan view of a cylindrical container having a utensil stored in a pocket.

Referring now to the drawings wherein like numerals designate like and corresponding parts throughout the several views, the present invention of a combination food and utensil container 20 comprises a body 21 having a sealed pocket 22 for storing an eating utensil 23 and at least one eating utensil 23 protectively stored in the pocket 22 of the container 20. An important benefit of the invention is that utensils are provided in a sealed pocket of a container at a lower cost than heretofore possible.

Figure 2:
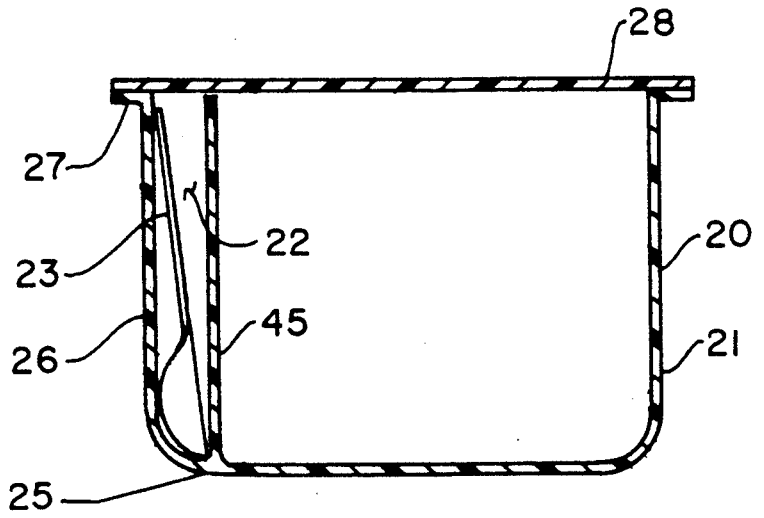
FIG. 2 is a vertical section taken on the line 2—2 of FIG. 1.

With reference to FIGS. 1 and 2, in the particular embodiment 20 disclosed therein a cylindrical body 21 has a bottom wall 25, an upward-extending cylindrical side wall 26 and an outward-extending flange 27. A flat cover 28 is bonded to the flange 27.

It will be appreciated from FIGS. 1 and 2, that my invention can be applied to a variety of container shapes.

With reference to FIGS. 5 and 6, another embodiment 41 is disclosed having a vertical pocket 42 for storing a utensil 43. The pocket 22 is formed in the containers body 21 by the union of a vertical inner wall 45, the bottom wall 25, the side wall 26 and the container's cover 28. Inside of the pocket 22 there is an upright spoon 23 which is accessible when the cover 28 is removed from the container's body 21. A benefit of this invention is that additional parts are not required for sealing the spoon 23 inside of the container 20.

From the foregoing detailed description it will be appreciated that my invention provides a combination food and utensil container free of contamination which is lower in cost than heretofore possible.

Although but a single embodiment of my invention has been described, it will be appreciated that other embodiments can be provided by changes in size, shape, materials and arrangement of parts without departing from the spirit hereof.

I claim:

1. In a food container for the storing and the partaking of food in a sanitary manner of the type having a unitary body and a cover attached to said body of said container, the improvement which comprises a vertical pocket in said body for storing at least one eating utensil, said body having a bottom wall, a sidewall extending upwardly from said bottom wall and a vertical pocket in the interior of said body unitarily formed with said body which is adapted for storing at least one eating utensil entirely apart from the remaining portion of the interior of said container, said pocket adjoining in sealing relationship said sidewall and said bottom wall and extending upwardly from said bottom wall to an upper edge which is substantially co-planar with the upper edge of said side wall; a cover attached to the upper end portion of said sidewall, said cover cooperating with said body to form a sealed pocket for storing the eating utensil in the interior of said container; and at least one eating utensil stored in said pocket.

2. The combination food and utensil container recited in claim 1 wherein said cover and said body cooperate to form a pocket for storing more than one eating utensil in said container.

3. The combination food and utensil container recited in claim 1 wherein said body is a cylindrical shaped body comprising a circular lower wall and an upward-extending cylindrical side wall.

4. The combination food and utensil container recited in claim 1 wherein said body is a rectangular shaped body comprising a rectangular lower wall and an upward-extending side rectangular wall.

* * * * *